US005605067A

United States Patent [19]

Juan

[11] Patent Number: 5,605,067

[45] Date of Patent: Feb. 25, 1997

[54] ELECTRONIC IDENTIFICATION DEVICE

[75] Inventor: Alain Juan, Chézard, Switzerland

[73] Assignee: Em Microelectronique-Marin S.A., Marin, Switzerland

[21] Appl. No.: 530,634

[22] Filed: Sep. 20, 1995

[30] Foreign Application Priority Data

Sep. 21, 1994 [FR] France ..... 94 11262

[51] Int. Cl.[6] ..... E05B 19/26

[52] U.S. Cl. ..... 70/413; 70/278; 70/395

[58] Field of Search ..... 70/267–278, 409, 70/413, 395

[56] References Cited

U.S. PATENT DOCUMENTS

| | | | |
|---|---|---|---|
| 3,347,072 | 10/1967 | Rose | 70/277 |
| 4,393,672 | 7/1983 | Gelhard | 70/277 |
| 4,458,512 | 7/1984 | Gelhard | 70/277 |
| 4,712,398 | 12/1987 | Clarkson et al. | 70/278 X |
| 4,849,749 | 7/1989 | Fukamachi et al. | 70/413 X |
| 4,924,686 | 5/1990 | Vonlanthen | 70/395 X |
| 5,156,032 | 10/1992 | Edgar | 70/413 X |
| 5,311,757 | 5/1994 | Spahn | 70/278 X |

FOREIGN PATENT DOCUMENTS

| | | | |
|---|---|---|---|
| 494471 | 7/1992 | European Pat. Off. . | |
| 559115 | 9/1993 | European Pat. Off. . | |
| 2655368 | 12/1989 | France . | |
| 4011179 | 1/1992 | Japan | 70/395 |
| 2187227 | 9/1987 | United Kingdom | 70/277 |

*Primary Examiner*—Suzanne L. Dino
*Attorney, Agent, or Firm*—Sughrue, Mion, Zinn, Macpeak & Seas

[57] ABSTRACT

Electronic identification device, notably a key, intended to be used with an electronic lock and comprising in a conducting body (16) two recesses (8,10) arranged facing each other and separated by an intermediate wall (14), an opening (12) being provided in the intermediate wall between the two recesses. Two conducting elements (22,28) are arranged in the two recesses and in the opening, these two elements being electrically and mechanically connected to each other with the aid of a stud (26) driven into a blind hole (34) respectively associated with the two conducting elements (22,28). The electronic unit (2) is electrically connected to the body (16) and to the two conducting elements (22,28) with the aid of conducting pads (48,50) arranged on a sheet (38) placed in one of the two recesses (8) between one plate (24) and the intermediate wall (14). The conducting elements (22,28) are electrically insulated from the conducting body (16).

8 Claims, 3 Drawing Sheets

ELECTRONIC IDENTIFICATION DEVICE

BACKGROUND OF THE INVENTION

The present invention concerns an electronic identification device, notably intended to control access to a locked enclosure.

SUMMARY OF THE INVENTION

More particularly, the present invention concerns a key comprising an electronic unit and at least one external electric contact pad electrically connected to this electronic unit. This key is intended to be used with an electronic lock comprising at least one electric terminal arranged so that this terminal is in contact with the external electric contact pad of the key when the latter is inserted in the electronic lock.

An aim of the invention is to provide an identification device comprising a conducting body having substantially parallel first and second faces, an electronic identification unit and an external electric contact pad provided on each of the first and second faces, these two external electric contact pads having substantially the same electric potential and being jointly connected to the electronic identification unit.

Another aim of the invention is to provide an identification device of this type capable of being easily integrated into a key and having a good resistance to mechanical stresses, in particular mechanical stresses generated on one or the other of the external electric contact pads.

These aims are achieved thanks to the identification device according to the invention, which comprises a conducting body having a substantially parallel first face and second face, an electronic identification unit and at least one external electric contact surface electrically connected to said electronic unit, this device being characterised in that it comprises:

- a first recess and a second recess arranged in said body and opening respectively onto said first and second faces, these first and second recesses being arranged substantially facing each other and separated from each other by an intermediate wall belonging to said conducting body,
- a first opening provided in said intermediate wall between said first recess and said second recess,
- a first conducting element and a second conducting element comprising respectively a first plate and a second plate arranged respectively in said first and second recesses so that they have no electric contact with the lateral walls of these recesses, the external face of said first plate forming said contact surface,
- assembling means for mechanically and electrically connecting said first and second plates in said first opening, said electronic unit being situated between these first and second plates,
- a non-conducting sheet arranged at least partially between said first plate and said intermediate wall, this sheet comprising a second opening substantially aligned with said first opening and a first conducting pad in electrical connection with said intermediate wall and electrically connected to said electronic unit, this sheet also comprising a second conducting pad in electrical contact with said first plate and electrically connected to said electronic unit, and
- an insulating layer arranged between said intermediate wall and said second plate.

The above-mentioned features result in an identification device which is compact, resistant and simple and inexpensive to assemble. The intermediate wall achieves the positioning of the first and second plates and guarantees a high level of security in the assembly of the various elements necessary for the identification function of the identification device according to the invention. It is also to be noted that one particular advantage of the invention arises from the fact that the identification device produces no protuberance or projections, which is particularly advantageous for a key.

Other features and advantages of the invention will also be described below with the aid of the following description, made with reference to the attached drawings, given by way of non-limiting example, in which:

DESCRIPTION OF PREFERRED EMBODIMENTS

With the aid of FIG. 1 to 4, an embodiment of an identification device according to the invention will be described below.

This device is formed by a key 1 intended to be used with an electronic lock (not shown) known to the man skilled in the art.

Figure 1:
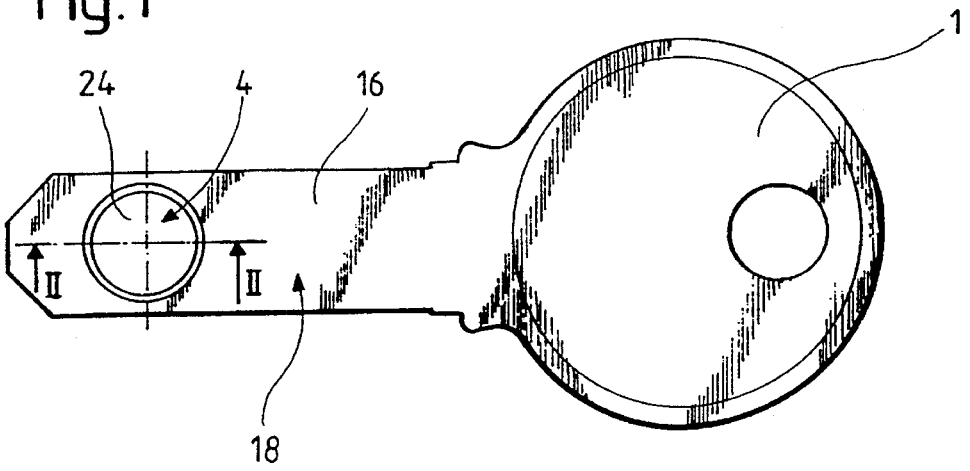
FIG. 1 shows schematically an overall view of the electronic identification device according to the invention.
Figure 4:
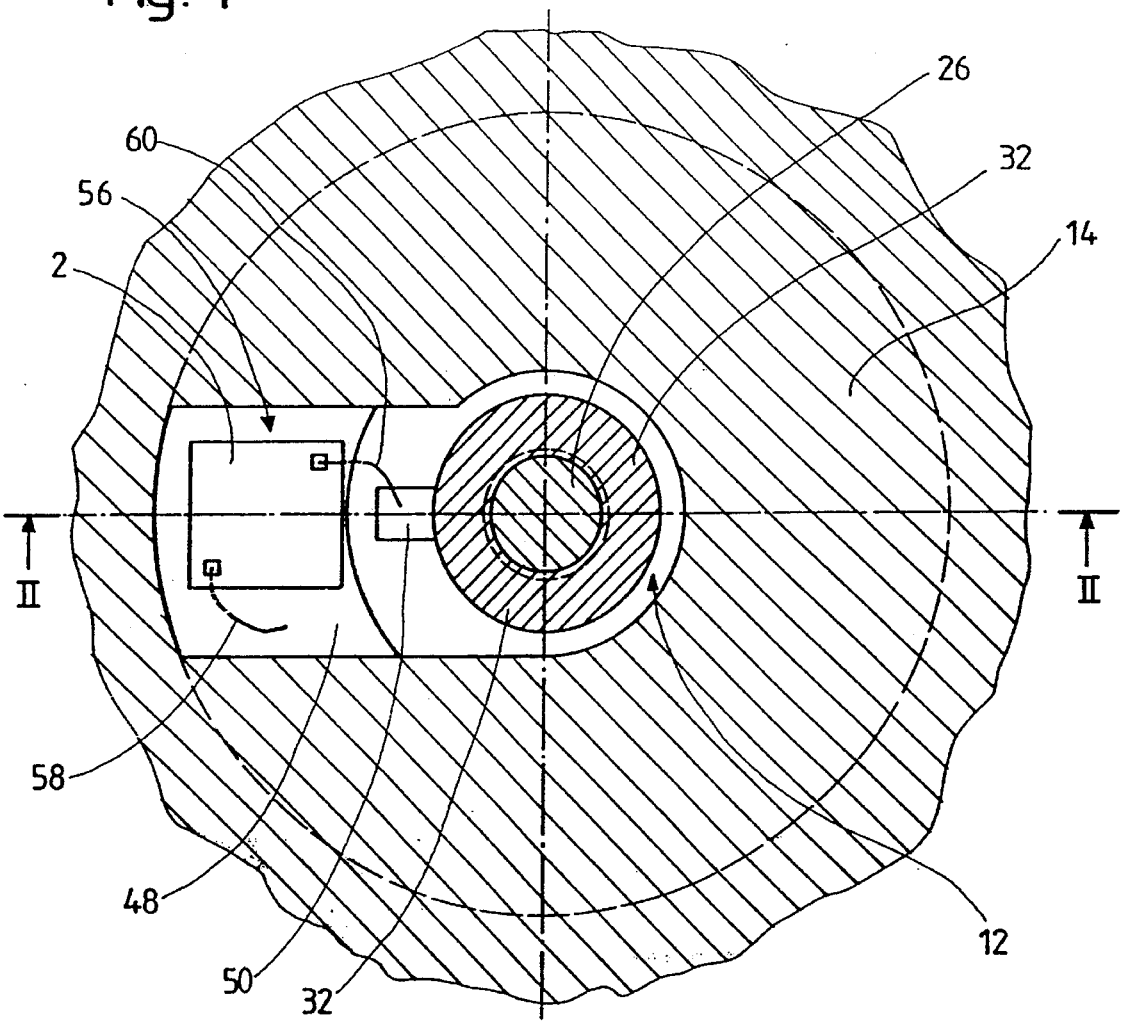
FIG. 4 is a cross-section along the line IV—IV of FIG. 2.
Figure 2:
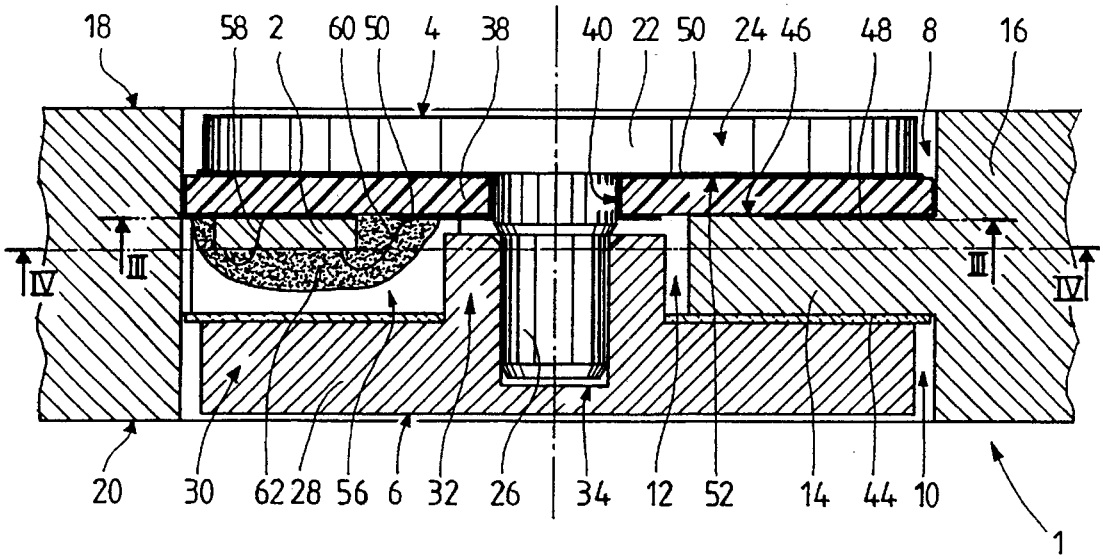
FIG. 2 is a schematical cross-section along the line II—II of FIG. 1.
Figure 3:
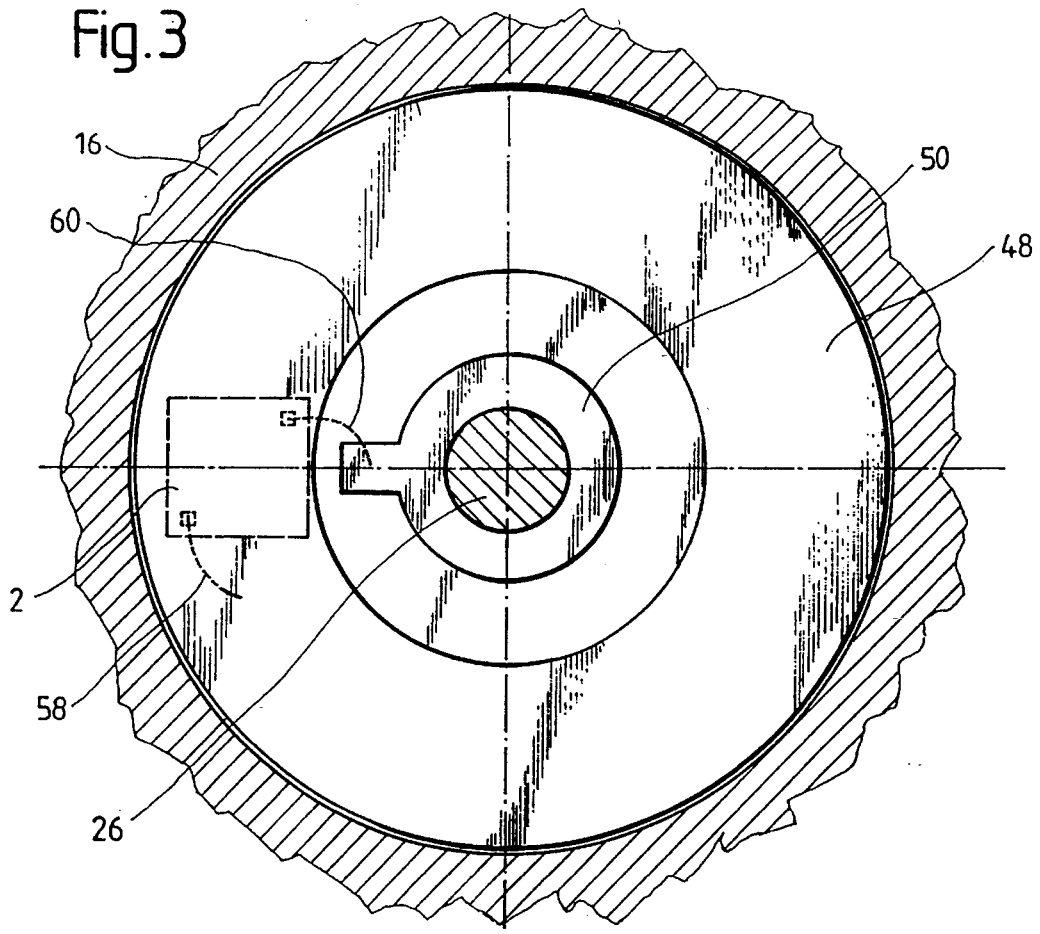
FIG. 3 is a cross-section along the line III—III of FIG. 2.

In FIG. 1, key 1 is represented completely schematically without bosses or recesses provided on its two faces and without teeth provided at the periphery of this key. However, it will be noted that an arrangement of this type is possible jointly with the various components required for the identification function integrated in key 1 which will be described below.

Key 1 comprises an electronic identification unit 2 and at least two external electric contact surfaces 4 and 6, these two contact surfaces 4 and 6 being electrically connected to each other and jointly to electronic unit 2 as will be described in more detail below. Key 1 comprises a first recess 8, a second recess 10 and an opening 12 connecting the two recesses 8 and 10. Opening 12 is arranged in an intermediate wall 14 separating the two recesses 8 and 10. Intermediate wall 14 belongs to the body 16 of key 1, this body 16 having a first face 18 and a second face 20 parallel to each other. It will be noted that recesses 8 and 10 are arranged facing each other. Opening 12 is provided in the central region of intermediate wall 14.

Key 1 also comprises a first conducting element 22, comprising a plate 24 and a stud 26, and a second conducting element 28 comprising a plate 30 and a projection 32 extending from the central region of plate 30 towards plate 24. A blind hole 34 is arranged in element 28 so that projection 32 has substantially the shape of a ring. Plates 24 and 30 are respectively arranged in recesses 8 and 10. Stud 26 is driven into blind hole 34 through opening 12. It will be noted more precisely that projection 32 engages in opening 12 without being in contact with the lateral wall of the latter and that stud 26 passes right through this opening. As a result of the assembly described above conducting elements 22 and 24 are electrically connected to each other.

The identification device also comprises a sheet 38 formed of a non-conducting material and situated between first plate 24 and intermediate wall 14. This sheet 38 has an opening 40 in its central part traversed by stud 26. Sheet 38 has substantially the radial dimensions of recess 8. Consequently, it positions element 22 and also element 28 jointly with intermediate wall 14. It will be noted that opening 40 is substantially aligned with opening 12 provided in body 16.

In order to insulate electrically body 16 from the assembly formed by elements 22 and 28, first an insulating layer 44 arranged between plate 30 and intermediate wall 14 is provided. Secondly, the radial dimensions of plates 24 and 30 are less than the dimensions of recesses 8 and 10. Likewise the radial dimensions of projection 32 are less that the dimensions of opening 12. The positioning of elements 22 and 28 is guaranteed by sheet 38 and also by the radial friction forces generated by the gripping of wall 14, insulating layer 44 and sheet 38 by plates 24 and 30. Thus, elements 22 and 28 are arranged in body 16 so that they have no point of electrical contact with said body 16.

A first conducting pad 48 is provided on face 46 of sheet 38, arranged in the peripheral area of this face 46. Pad 48 is held by pressure against intermediate wall 14 and consequently in electric contact with the latter. A second conducting pad 50 is provided in the central area of face 46 of sheet 38, this second pad 50 extending continuously from this central area to opening 40 and over second face 52 of sheet 38. Second pad 50 is held by pressure against plate 24 of element 22 and consequently in electric contact with this plate 24. It will be noted that pad 50 is arranged on face 46 of sheet 38 so that it has no point of electric contact with intermediate wall 14. Likewise, pad 50 is arranged on face 52 of sheet 38 so that it has no electric contact with the lateral wall of recess 8. It will also be noted that sheet 38 forms the substrate of a double face printed circuit.

Electronic unit 2 is arranged on face 46 of sheet 38, a cavity 56 being provided between sheet 38 and plate 30 for this electronic unit 2. This cavity 56 is formed by a through opening provided in intermediate wall 14.

Electronic unit 2 is electrically connected by electric connecting means 58 to conducting pad 48 and by electric connecting means 60 to conducting pad 50. It will be noted that electronic unit 2 and electric connecting means 58 and 60 are embedded in resin 62.

Figure 5:
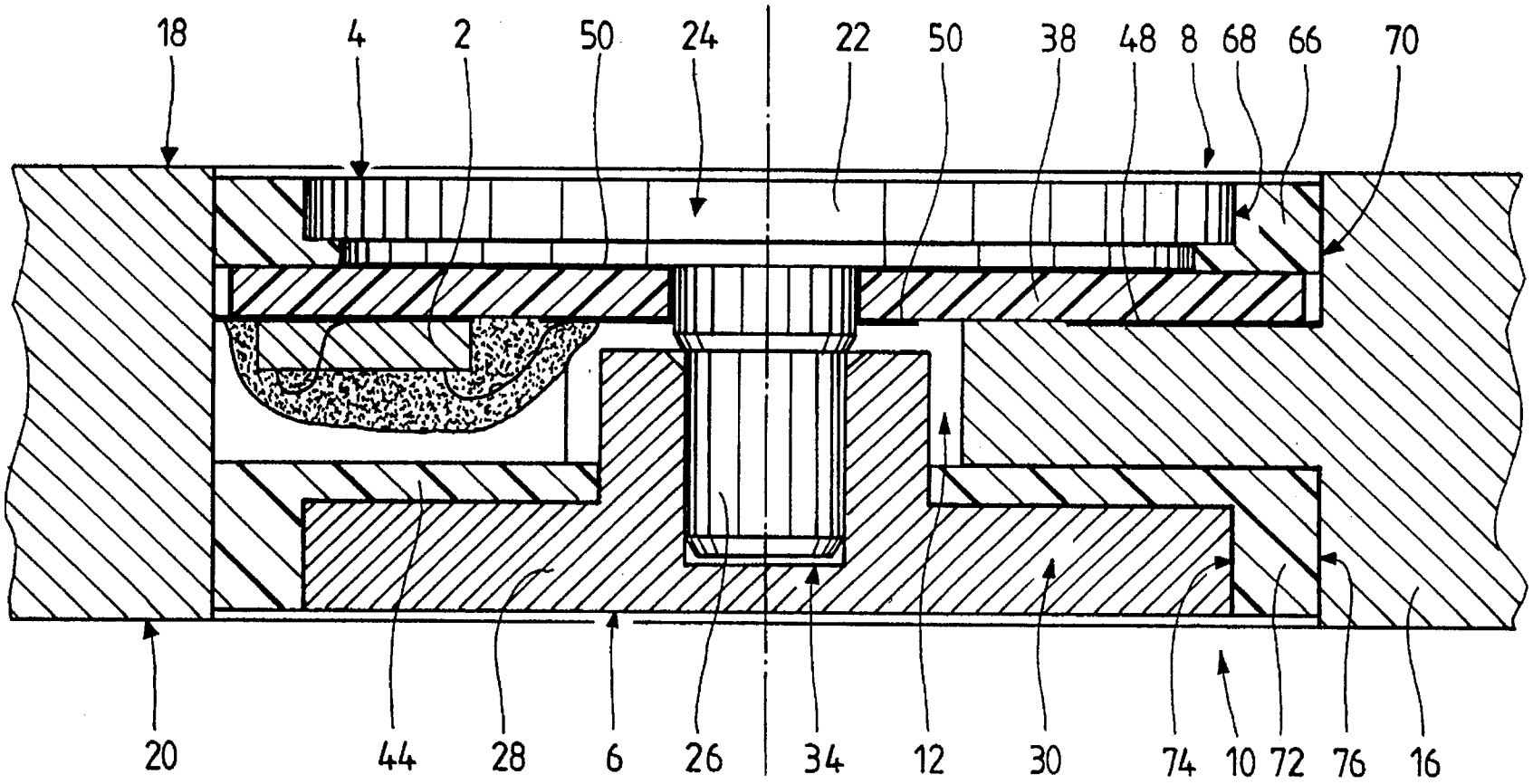
FIG. 5 is an alternative embodiment of the identification device shown in FIG. 2.

FIG. 5 shows an alternative embodiment of the identification device described above. The references already described previously will not be described again here.

This alternative embodiment differs from the embodiment described above in that an insulating part 66 having substantially the shape of a ring is provided, this insulating part 66 being arranged between lateral wall 68 of plate 24 and lateral wall 70 of recess 8. Likewise, an insulating part 72 is also provided between lateral surface 74 of plate 30 and lateral surface 76 of recess 10. This insulating part 72 forms a single piece with insulating layer 44. According to this embodiment, the electric insulation of conducting elements 22 and 28 is perfectly guaranteed and conducting pads 48 and 50 are protected.

One will mention lastly that insulating parts 66 and 72, like insulating layer 44 and sheet 38, may have a certain elasticity so as to absorb the mechanical stresses exerted on faces 4 and 6 of plates 24 and 30, while still guaranteeing that the above-described electric contacts are maintained.

What is claimed is:

1. An identification device comprising a conducting body having a substantially parallel first face and second face, an electronic identification unit and at least one external electric contact surface electrically connected to said electronic unit, wherein this device comprises:

a first recess and a second recess arranged in said body and opening respectively onto said first and second faces, these first and second recesses being arranged substantially facing each other and separated from each other by an intermediate wall belonging to said conducting body, a first opening provided in said intermediate wall between said first recess and said second recess, a first conducting element and a second conducting element comprising respectively a first plate and a second plate arranged respectively in said first and second recesses so that they have no electric contact with said lateral walls of these recesses, the external face of said first plate forming said contact surface, assembling means for mechanically and electrically connecting said first and second plates in said first opening, said electronic unit being situated between said first and second plates, a non-conducting sheet arranged at least partially between said first plate and said intermediate wall, said sheet comprising a second opening substantially aligned with said first opening and a first conducting pad in electrical connection with said intermediate wall and electrically connected to said electronic unit, said sheet also comprising a second conducting pad in electrical contact with said first plate and electrically connected to said electronic unit, and an insulating layer arranged between said intermediate wall and said second plate.

2. An identification device according to claim 1, wherein said assembling means are formed by a stud protruding from said first plate and by a blind hole arranged in a projection of said second conducting element, said stud traversing said second opening and being driven into said blind hole, said projection and said stud being without electric contact with said intermediate wall.

3. An identification device according to claim 1 or 2, wherein said sheet has a first face and a second face, and wherein a cavity is provided between said sheet and said second plate for said electronic unit which is arranged on said first face of said sheet.

4. An identification device according to claim 3, wherein said first conducting pad is arranged in a peripheral area of said first face of said sheet, and second conducting pad being arranged partially in a central area of said first face onto which opens said second opening, said second conducting pad extending continuously from this central area into said second opening and over said second face of said sheet, said first conducting pad being situated at least partially facing said intermediate wall, and said second conducting pad being situated at least partially facing said first plate, said sheet abutting against said first plate and against said intermediate wall.

5. An identification device according to claim 4, wherein said cavity is formed by a third through opening provided in said intermediate wall.

6. An identification device according to claim 1, wherein insulating parts are provided for electrically insulating said first and second plates from said lateral walls of said first and second recesses.

7. An identification device according to claim 1, comprising an electronic key, said conducting body being intended to be inserted into an electronic lock provided with at least one electric contact terminal arranged to be in electric contact with one of said first and second plates when said body is inserted into said lock.

8. An identification device according to claim 3, wherein said cavity is formed by a third through opening provided in said intermediate wall.

* * * * *